US007973674B2

(12) United States Patent
Bell et al.

(10) Patent No.: US 7,973,674 B2
(45) Date of Patent: Jul. 5, 2011

(54) VEHICLE-TO-VEHICLE TRAFFIC QUEUE INFORMATION COMMUNICATION SYSTEM AND METHOD

(75) Inventors: David R. Bell, Southampton (GB); Christopher S. Bygrave, Eastleigh (GB); Phillip Norton, Eastleigh (GB)

(73) Assignee: International Business Machines Corporation, Armonk, NY (US)

( * ) Notice: Subject to any disclaimer, the term of this patent is extended or adjusted under 35 U.S.C. 154(b) by 380 days.

(21) Appl. No.: 12/194,581

(22) Filed: Aug. 20, 2008

(65) Prior Publication Data

US 2010/0045488 A1 Feb. 25, 2010

(51) Int. Cl.
*G08G 1/00* (2006.01)

(52) U.S. Cl. ..... 340/901; 340/435; 340/902; 340/903; 340/932

(58) Field of Classification Search ..... 340/901–905, 340/988, 435, 932; 701/300, 301
See application file for complete search history.

(56) References Cited

U.S. PATENT DOCUMENTS

| | | | | |
|---|---|---|---|---|
| 5,214,793 | A | 5/1993 | Conway et al. | |
| 5,424,726 | A * | 6/1995 | Beymer | 340/902 |
| 5,589,827 | A * | 12/1996 | Scurati | 340/901 |
| 5,680,122 | A * | 10/1997 | Mio | 340/932 |
| 6,121,896 | A * | 9/2000 | Rahman | 340/902 |
| 6,278,360 | B1 * | 8/2001 | Yanagi | 340/903 |
| 6,313,758 | B1 * | 11/2001 | Kobayashi | 340/932 |
| 6,369,720 | B1 * | 4/2002 | Wilhelm | 340/905 |
| 6,542,808 | B2 | 4/2003 | Mintz | |
| 7,304,589 | B2 | 12/2007 | Kagawa | |
| 2002/0026277 | A1 | 2/2002 | Kerner et al. | |
| 2004/0230373 | A1 * | 11/2004 | Tzamaloukas | 701/208 |
| 2005/0088318 | A1 * | 4/2005 | Liu et al. | 340/902 |
| 2007/0001869 | A1 * | 1/2007 | Hunzinger | 340/903 |
| 2007/0109146 | A1 * | 5/2007 | Tengler et al. | 340/902 |

(Continued)

FOREIGN PATENT DOCUMENTS

EP 1 296 305 A1 3/2003

OTHER PUBLICATIONS

"General Motors Develops Vehicle-to-Vehicle Communication," Oct. 27, 2005, 2 pages. http://www.worldcarfans.com/print/2051027.002.

(Continued)

*Primary Examiner* — Thomas J Mullen
(74) *Attorney, Agent, or Firm* — Gibb I.P. Law Firm, LLC

(57) ABSTRACT

Disclosed are embodiments of a vehicle-to-vehicle traffic queue information communication system, a traffic queue information communication device, and method. The system and method embodiments incorporate the use of multiple vehicles. Each vehicle is equipped with a traffic queue information communication device. Each traffic queue information communication device can be used to determine if its corresponding vehicle has entered or exited a queue in a single lane of traffic. When the vehicle is in a queue, the device can communicate with the immediately adjacent vehicles in front and behind. Specifically, it can receive data from the preceding vehicle in the queue and use the received data to determine its position in the queue as well as the estimated time it will take to travel through the queue. Revised data can then be transmitted by the device to the next vehicle in the queue for making the same determinations.

19 Claims, 2 Drawing Sheets

U.S. PATENT DOCUMENTS

2008/0014909 A1* 1/2008 Shimomura ..... 455/414.1

OTHER PUBLICATIONS

Morla, "Vision of Congestion-Free Road Traffic and Cooperating Objects," Nov. 2005, pp. 1-8.

Wilmink, et al., "Cooperate and Survive," Traffic Safety, Traffic Technology International Annual, 2008, pp. 36-38.

TomTom, "Go 720 Traffic (Western Europe) includes RDS/TMC Receiver," 2007, 5 pages, http://www.shiroi.co.uk/tomtom-go-720-traffice-western-europ-includes-rds-tmc-receiver-descrpti...

Eichler, et al., "Simulation of Car-to-Car Messaging: Analyzing the Impact on Road Traffic," 4 pages.

Eichler, et al, "Car-to-Car Communication," 6 pages.

* cited by examiner

VEHICLE-TO-VEHICLE TRAFFIC QUEUE INFORMATION COMMUNICATION SYSTEM AND METHOD

BACKGROUND

1. Field of the Invention

The embodiments of the invention generally relate to vehicle-to-vehicle communication systems and, more specifically, to a vehicle-to-vehicle traffic queue information communication system, a traffic queue information communication device and a method for determining traffic queue information, including but not limited to, the position of a particular vehicle within a queue, the average speed of the queue and the estimated time for the particular vehicle to reach the front of the queue.

2. Description of the Related Art

When there is a traffic incident and a queue forms, there is currently no accurate, real-time, way for a driver of a particular vehicle to receive detailed information about how far that particular vehicle is from the front of the queue and how long it will take that particular vehicle to reach the front of the queue. For example, periodic radio or web-based traffic announcements provide information regarding the location of an accident and the estimated average time it will take vehicles to pass through the resulting traffic queue. Other systems can provide what is referred to as real-time traffic information. With such systems, traffic data is transmitted over a radio frequency and picked up by devices, such as global positioning systems (GPSs). The received traffic data indicates hot spots and can provide limited information regarding traffic congestion and average speed. However, neither traffic announcements, nor current real-time traffic information systems, can provide details regarding particular vehicles.

SUMMARY

In view of the foregoing, disclosed herein are embodiments of a vehicle-to-vehicle traffic queue information communication system, a traffic queue information communication device, and a method. The system and method embodiments incorporate the use of multiple vehicles. Each vehicle is equipped with a traffic queue information communication device. Each traffic queue information communication device can be used to determine if its corresponding vehicle has entered or exited a queue in a single lane of traffic. When the vehicle is in a queue, the device can communicate with the immediately adjacent vehicles in front and behind. Specifically, it can receive data from the preceding vehicle in the queue and use the received data to determine its position in the queue as well as the estimated time it will take to travel through the queue. Revised data can then be transmitted by the device to the next vehicle in the queue for making the same determinations.

More particularly, embodiments of vehicle-to-vehicle traffic queue information system are disclosed. The system embodiments comprise a plurality of vehicles and a plurality of traffic queue information communication devices. The vehicles are operating in a single lane of traffic and each specific vehicle is equipped with a single corresponding traffic queue information communication device.

Each traffic queue information communication device can comprise a communication apparatus and a processor. Specifically, the communication apparatus can be adapted to receive a first signal from a directly preceding vehicle (i.e., from the vehicle in front of and immediately adjacent to the specific vehicle in the single lane of traffic). This first signal can comprise a first set of traffic queue data and, more particularly, the position of the directly preceding vehicle in a queue within the single lane of traffic and also an average speed of the queue (i.e., the average time it takes a vehicle to move forward one position in the queue). The processor can be adapted to determine, based on the first set of traffic queue data, a second set of traffic queue data. This second set of traffic queue data can comprise the current position of the specific vehicle in the queue and the revised average speed of the queue. A display can be adapted to visually display this second set of traffic queue data to the user of the specific vehicle and/or any subsequently calculated traffic queue information (e.g., an estimated time until the starting position of the queue is reached). Alternatively, a speaker system can be adapted to audibly provide such information to the user of the specific vehicle. The communication apparatus can further be adapted to transmit a second signal with the second set of traffic queue data to a directly following vehicle (i.e., to the vehicle behind and immediately adjacent to the specific vehicle in the single lane of traffic).

Additionally, each traffic queue information communication device can comprise a speed monitor and a signal monitor. The speed monitor can be adapted to determine when the specific vehicle enters a queue in the single lane of traffic in order to initiate the signal receipt and transmission processes by the communication apparatus and further to determine when the specific vehicle exits the queue in order to cease such processes. The signal monitor can be adapted to monitor receipt of first signals by the communication apparatus and to determine when the communication apparatus stops receiving such signals in order to determine when the specific vehicle reaches the starting position of the queue. That is, once the communication apparatus stops receiving signals, a determination can be made that there is no longer a vehicle in front of the specific vehicle in the queue and, thus, that the specific vehicle is at the front of the queue.

Also disclosed herein are embodiments of an associated vehicle-to-vehicle traffic queue information communication method. The method embodiments comprise receiving, by a traffic queue information communication device installed on a specific vehicle, a first signal from a directly preceding vehicle (i.e., from the vehicle in front of and immediately adjacent to the specific vehicle in a single lane of traffic). This first signal can comprise a first set of traffic queue data comprising the position of the directly preceding vehicle in a queue and the average speed of the queue (i.e., the average time it takes a vehicle to move forward one position in the queue). Based on this first set of traffic queue data, the traffic queue information communication device can determine a second set of traffic queue data. This second set of traffic queue data can comprise at least the current position of the specific vehicle in the queue and the revised average speed of the queue. This second set of traffic queue data and/or any other subsequently calculated traffic queue information (e.g., an estimated time until the starting position of the queue is reached) can be visually displayed or audibly provided to a user of the specific vehicle. Furthermore, the traffic queue information communication device can transmit a second signal with the second set of traffic queue data to a directly following vehicle (i.e., the vehicle behind and immediately adjacent to the specific vehicle in the single lane of traffic).

Additionally, the method embodiments can comprise monitoring, by the traffic queue information communication device, the speed of the specific vehicle to determine when the specific vehicle enters a queue in a single lane of traffic in order to initiate the signal receiving and transmitting processes and to further determine when the specific vehicle exits the queue in order to cease such processes. The method embodiments can also comprise monitoring, by the traffic queue information communication device, receipt of first signals and determining when the traffic queue information communication device stops receiving such signals in order to determine when the specific vehicle reaches a starting position of the queue. That is, once the traffic queue information communication device stops receiving signals, a determination can be made that there is no longer a vehicle in front of the specific vehicle in the queue and, thus, that the specific vehicle is at the front of the queue.

BRIEF DESCRIPTION OF THE SEVERAL VIEWS OF THE DRAWINGS

The embodiments of the invention will be better understood from the following detailed description with reference to the drawings, which are not necessarily drawing to scale and in which.

DETAILED DESCRIPTION

The embodiments of the invention and the various features and advantageous details thereof are explained more fully with reference to the non-limiting embodiments that are illustrated in the accompanying drawings and detailed in the following description.

As mentioned above, when there is a traffic incident and a queue forms, there is currently no accurate, real-time, way for a driver of a particular vehicle to receive detailed information about how far that particular vehicle is from the front of the queue and how long it will take that particular vehicle to reach the front of the queue. For example, periodic radio or web-based traffic announcements provide information regarding the location of an accident and the estimated average time it will take vehicles to pass through the resulting traffic queue. Other systems can provide what is referred to as real-time traffic information. With such systems, traffic data is transmitted over a radio frequency and picked up by devices, such as global positioning systems (GPSs). The received traffic data indicates hot spots and can provide limited information regarding traffic congestion and average speed. However, neither traffic announcements, nor current real-time traffic information systems, can provide details regarding particular vehicles.

In view of the foregoing, disclosed herein are embodiments of a vehicle-to-vehicle traffic queue information communication system, a traffic queue information communication device, and a method. The system and method embodiments incorporate the use of multiple vehicles. Each vehicle is equipped with a traffic queue information communication device. Each traffic queue information communication device can be used to determine if its corresponding vehicle has entered or exited a queue in a single lane of traffic. When the vehicle is in a queue, the device can communicate with the immediately adjacent vehicles in front and behind. Specifically, it can receive data from the preceding vehicle in the queue and use the received data to determine its position in the queue as well as the estimated time it will take to travel through the queue. Revised data can then be transmitted by the device to the next vehicle in the queue for making the same determinations.

Figure 1:
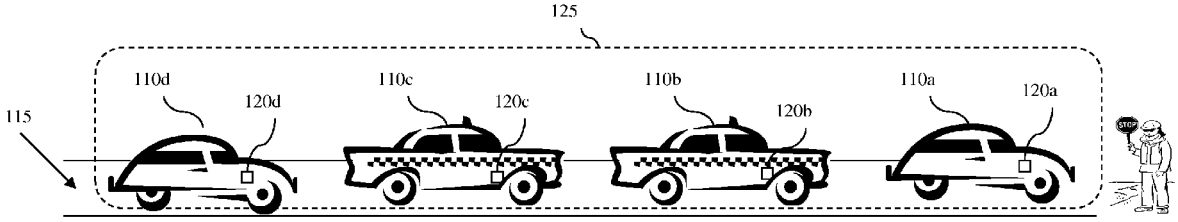
FIG. 1 is an illustration of an exemplary traffic queue incorporating the vehicle-to-vehicle traffic queue information communication system and method embodiments of the present invention.

More particularly, referring to FIG. 1, embodiments of vehicle-to-vehicle traffic queue information system are disclosed. The system embodiments comprise a plurality of vehicles (e.g., 110*a*-110*d*). The vehicles 110*a-d* are operating in a single lane of traffic 115 and each specific vehicle 110*a*-110*d* is equipped with a corresponding traffic queue information communication device 120*a*-120*d*. That is, a traffic queue information communication device 120*a*-120*d* is installed in each vehicle 110*a*-110*d*, respectively.

Figure 2:
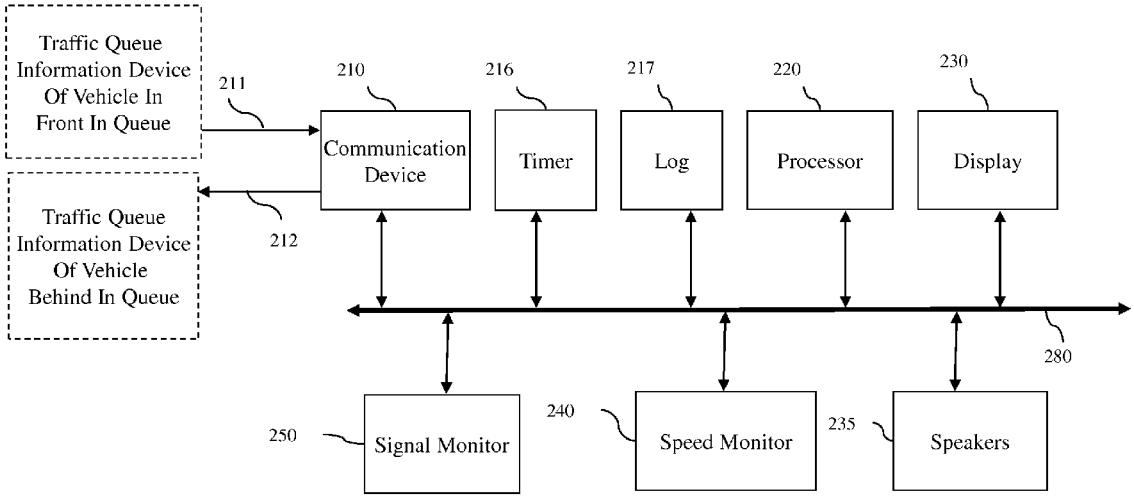
FIG. 2 is a block diagram illustrating an embodiment of a traffic queue information communication device of the present invention that can be installed in each of the vehicles of FIG. 1.

Each traffic queue information communication device 120*a*-120*d* comprises the same components and same corresponding functions, as illustrated in FIG. 2. For ease of explanation, these components and their corresponding functions are described with respect to the traffic queue information communication device 120*c* of vehicle 110*c*. Thus, referring to FIG. 2 in combination with FIG. 1, an embodiment of the traffic queue information communication device 120*c* of the present invention comprises a wireless communication apparatus 210 (i.e., a wireless communication device), a timer 216, a memory device 217, a processor 220 and a display 230.

The communication apparatus 210 can comprise a line-of-sight communication apparatus. For example, the communication apparatus 210 can comprise a short-range infrared communication apparatus, including an infrared transmitter and receiver, that allows bidirectional communication between the specific vehicle 110*c* and immediately adjacent vehicles that are traveling in the same lane of traffic 115 as the specific vehicle 110*c* and that are further not separated from the specific vehicle 110*c* by more than a predetermined distance (e.g., 10 meters). Thus, the communication apparatus 210 of vehicle 110*c* can allow communication between the specific vehicle 110*c* and the corresponding communication apparatuses of both the directly preceding vehicle 110*b* (i.e., the vehicle in front of and immediately adjacent to the specific vehicle 110*c*) and the directly following vehicle 110*d* (i.e., the vehicle behind and immediately adjacent to the specific vehicle 110*c*).

The communication apparatus 210 can be adapted to receive a first signal 211 from the directly preceding vehicle 110*b* in a queue 125. This first signal 211 can comprise a first set of traffic queue data. The first set of traffic queue data can comprise the position (i.e., the starting or first position, second position (as shown), third position, etc.) in the queue 125 of the directly preceding vehicle 110*b*. The first set of traffic queue data can also comprise an average speed of the queue 125 (i.e., the average time it takes a vehicle to move forward one position in the queue (qAvTime1Space)). Once the first signal 211 has been received, a timer 216 can be automatically started and, additionally, the first set of data can be logged (e.g., into a log or memory 217).

Additionally, the processor 220 can be adapted to determine, based on the first set of traffic queue data, a second set of traffic queue data and to log that second set of data into log 217. This second set of traffic queue data can comprise the current position of the specific vehicle 110*c* in the queue 125. That is, the current position of the specific vehicle 110*c* will be the position of the vehicle 110*b*, incremented by one. Additionally, the second set of traffic queue data can comprise the revised average speed of the queue 125 (i.e., a current average time it takes a vehicle to move forward one position in the queue (qAvTime1Space)). That is, whenever a vehicle moves forward the time taken for the vehicle to move forward that last space is stored. If the vehicle has been stationary for longer than the last time it took to move forward one space, then the value of the current timer 216 is used to calculate the overall average speed of the queue (qAvTime1Space=((qAvTime1Space*position−1)+myAvTime1Space)/position), the position being the current position of the specific vehicle 110*c* as incremented in the second set of data. The processor 220 can further be adapted to determine, based on the second set of traffic queue data, an estimated time until the specific vehicle 110*c* reaches the starting position of the queue 125 by multiplying the position of the specific vehicle 110*c* in the queue by the revised average speed of the queue 125 (timeToFront=qAvTime1Space*position). The display 230 can comprise a graphical user interface (GUI) or heads-up (HUD) display on the vehicle dash that is adapted to visually display this second set of traffic queue data to the user of the specific vehicle 110*c* and/or any subsequently calculated traffic queue information (e.g., an estimated time until the starting position of the queue is reached). Alternatively, this same information (i.e., the second set of traffic queue data and/or any subsequently calculated traffic queue information) can be audibly provided to the user of the specific vehicle 110*c* (e.g., through a speaker system 235).

The communication apparatus 210 can further be adapted to transmit a second signal 212 with this second set of traffic queue data to a directly following vehicle 110*d* (i.e., to the communication apparatus of the traffic queue information communication device of the vehicle behind and immediately adjacent to the specific vehicle in the single lane of traffic 115), once the second set of traffic data is determined by the processor 220. The traffic queue information communication device 120*d* of the following vehicle 110*d* can then perform the same functions in the same manner, as described above, in order to determine the position of the vehicle 110*d* in the queue 125 and also the time it will take the vehicle 110*d* to reach the front of the queue 125.

It should be noted that signal broadcasting by the communication apparatus 210 is limited (e.g., by line of sight) to ensure that vehicle-to-vehicle communication only occurs between adjacent vehicles traveling in the same lane of traffic because the algorithms applied by the processor 220 (described above) are only applicable to a single lane of traffic 115. This has the advantage that if there are multiple lanes, the data is accurate for the specific lane the vehicle is traveling in and the information will be automatically updated if a vehicle changes lanes or exits the roadway. It should also be noted that the communication apparatuses 210 in the traffic queue information communication devices 120*a*-120*d* of each vehicle 110*a*-110*d* can further be adapted to communicate signals (i.e., to receive and transmit data) at predetermined intervals (e.g., every 30 seconds, every minute, etc.). This ensures that the most up to date information is being displayed to vehicle users. For example, if a vehicle ahead in the queue changes lane or exits the road, the very next round of signals will account for the jump in position of the following vehicles.

For such a system to work the traffic queue information communication devices 120*a*-120*d* on each vehicle 110*a*-110*d* must further be able to identify a queue 125 and must also be able to recognize when its corresponding vehicle is at the front of the queue 125. Thus, again referring to FIG. 2 in combination with FIG. 1, each traffic queue information communication device 120*a*-120*d* can further comprise a speed monitor 240 and a signal monitor 250.

The speed monitor 240 can be adapted to determine when the specific vehicle 110*c* enters a queue 125 in the single lane of traffic 115 in order to automatically initiate the signal receipt and transmission processes by the communication apparatus 210 and further to determine when the specific vehicle exits the queue 125 (e.g., by passing through the front of the queue, by changing lanes, by exiting the roadway, etc.) in order to cease such processes. For example, threshold criteria for defining a queue can be predetermined. That is, a queue is established when a vehicle is determined to have dropped below a predetermined speed for a predetermined amount of time. To make such a determination, the speed monitor 240 can be in communication with the vehicle's speedometer and can monitor the vehicle's speed over time. When the queue threshold criteria are met, communication with adjacent vehicles (e.g., 110*b* and 110*d*) is initiated. In the same manner, when the vehicle 110*c* begins to accelerate above the threshold speed, a determination is made that the vehicle 110*c* is no longer in the queue 125 and communication ceases. It should be noted that the speed monitor 240 can be adapted to continuously or periodically monitor the speed of the specific vehicle 110*c* in such a way as to ensure that signals are only propagated when a queue 125 exists. That is, the speed monitor 240 should be adapted to (i.e., programmed to) verify that a queue 125 exists prior to transmitting any data to a following vehicle 110*d*. If the specific vehicle 110*c* is traveling above the predetermined speed for the predetermined amount of time (i.e., is outside the queue threshold criteria) no signals are transmitted to the following vehicle 110*d*. This ensures that vehicles do not propagate false signals, regardless of how close other vehicles are or what signals other vehicles are transmitting, and also ensures that vehicles leaving the queue 125 (e.g., by changing lanes or exiting the roadway) stop sending signals.

The signal monitor 250 can be adapted to monitor receipt of first signals 211 by the communication apparatus 210 in order to determine when the communication apparatus 210 stops receiving such signals for a predetermined amount of time (e.g., 30 seconds, 1 minutes, etc.) and, thereby, to determine when the specific vehicle 110*c* reaches the starting position of the queue 125. That is, once the communication apparatus 210 stops receiving signals, a determination can be made that there is no longer a vehicle in front of the specific vehicle 110*c* in the queue 125 and, thus, that the specific vehicle 110*c* is at the front of the queue 125. The vehicle at the front of the queue must be identified so that the other vehicles in the queue 125 can subsequently determine their respective positions.

It is anticipated that the various components of the traffic queue information communication device 120*c*, as discussed in detail above, may communicate directly or via a bus 280, as illustrated.

Figure 3:
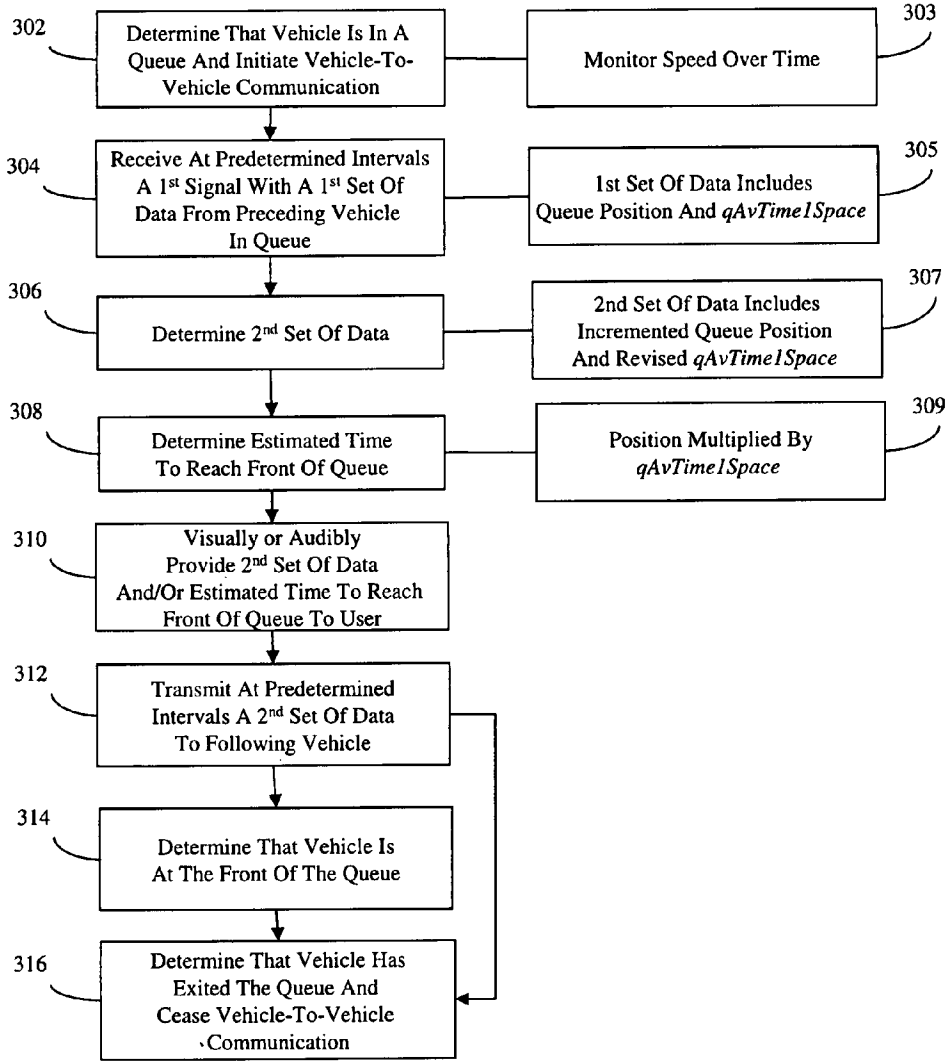
FIG. 3 is a flow diagram illustrating an embodiment of the method of the present invention.

Also, referring to the flow diagram of FIG. 3 in combination with FIGS. 1 and 2, disclosed herein are embodiments of an associated vehicle-to-vehicle traffic queue information communication method. The method embodiments comprise receiving, by a traffic queue information communication device 120*c* installed on a specific vehicle 110*c*, a first signal 211 from a directly preceding vehicle 110*b* (i.e., from the vehicle in front of and adjacent to the specific vehicle in a single lane of traffic 115) (304). This first signal 211 can comprise a first set of traffic queue data comprising the position (i.e., the starting or first position, second position (as shown), third position, etc.) of the directly preceding vehicle 110*b* in a queue 125. This first set of traffic queue data can also comprise the average speed of the queue 125 (i.e., the average time it takes a vehicle to move forward one position in the queue (qAvTime1Space)) (305). Once the first signal 211 has been received, a timer 216 can be automatically started and, additionally, the first set of data can be automatically logged (e.g., into log or memory 217).

Then, based on this first set of traffic queue data, the traffic queue information communication device 120*c* can determine a second set of traffic queue data and log that second set of data into the log 217 (306). This second set of traffic queue data can comprise at least the current position of the specific vehicle 110*c* in the queue 125 and the revised average speed of the queue 125 (307). Specifically, the current position of the specific vehicle 110*c* is the position of the vehicle 110*b*, incremented by one. The revised average speed of the queue 125 is the current average time it takes a vehicle to move forward one position in the queue (qAvTime1Space)). That is, whenever a vehicle moves forward the time taken for the vehicle to move forward that last space is stored. If the vehicle has been stationary for longer then the last time it took to move forward one space, then the value of the current timer 216 is used to calculate the overall average speed of the queue (qAvTime1Space=((qAvTime1Space*position−1)+myAvTime1Space)/position) the position being the current position of the specific vehicle 110*c* as incremented in the second set of data. Additionally, based on this second set of traffic queue data, the estimated time until the specific vehicle 110*c* reaches the starting position of the queue 125 can be determined by multiplying the position of the specific vehicle 110*c* in the queue by the revised average speed of the queue 125 (timeToFront=qAvTime1Space*position) (308-309). This second set of traffic queue data and/or any other subsequently calculated traffic queue information (e.g., an estimated time until the starting position of the queue is reached) can be either visually displayed (e.g., by display 230 on the vehicle's dashboard) or audibly provided (e.g., by speakers 235) to a user of the specific vehicle 110*c* (310).

Furthermore, the traffic queue information communication device 120*c* can transmit a second signal 212 with the second set of traffic queue data to a directly following vehicle 110*d* (i.e., the vehicle behind and adjacent to the specific vehicle in the single lane of traffic 115) (312). The traffic queue information communication device 120*d* of the following vehicle 110*d* can then perform the same processes in the same manner, as described above, in order to determine the position of the vehicle 110*d* in the queue 125 and also the time it will take the vehicle 110*d* to reach the front of the queue 125.

It should be noted that signal broadcasting at processes 304 and 312 is limited (e.g., by line of sight) to ensure that vehicle-to-vehicle communication only occurs between adjacent vehicles traveling in the same lane of traffic 115 because the algorithms applied by the processor 220 are only applicable to a single lane of traffic 115. This has the advantage that if there are multiple lanes, the data is accurate for the specific lane the vehicle is traveling in and the information will be automatically updated if a vehicle changes lanes or exits the roadway. It should also be noted that signal broadcasting at processes 304 and 312 is performed at predetermined intervals (e.g., every 30 seconds, every minute, etc.). This ensures that the most up to date information is being displayed to vehicle users at process 310. For example, if a vehicle ahead in the queue changes lane or exits the road, the very next round of signals will account for the jump in position of the following vehicles.

For such a method to work the traffic queue information communication devices 120*a*-120*d* on each vehicle 110*a*-110*d* must further be able to identify a queue 125 and must also be able to recognize when its corresponding vehicle is at the front of the queue 125. Thus, the method embodiments can comprise monitoring, by the traffic queue information communication device 120*c*, the speed of the specific vehicle 110*c* to determine when the specific vehicle 110*c* enters a queue in a single lane of traffic 115 and to thereafter automatically initiate the receiving and transmitting processes 304 and 312 (302). For example, threshold criteria for defining a queue can be predetermined. That is, a queue is established when a vehicle is determined to have dropped below a predetermined speed for a predetermined amount of time. To make such a determination, a speed monitor 240 can be in communication with the vehicle's speedometer and can monitor the vehicle's speed over time (303). When the queue threshold criteria are met, communication with adjacent vehicles (e.g., 110*b* and 110*d*) is initiated. A determination can also be made as to when the specific vehicle 110*c* leaves a queue 125 (e.g., by passing through the front of the queue, by changing lanes, by exiting the roadway, etc.) in order to cease vehicle-to-vehicle communications (316). For example, when the vehicle 110*c* begins to accelerate above the threshold speed, a determination is made that the vehicle 110*c* is no longer in the queue 125 and communication ceases.

It should be noted that monitoring can be continuous or periodic, but should be performed so as to ensure that signals are only propagated when a queue 125 exists. That is, prior to transmitting any data to a following vehicle 110*d*, the fact that a queue 125 still exists should be verified. If the specific vehicle 110*c* is traveling above the predetermined speed for the predetermined amount of time (i.e., is outside the queue threshold criteria) no signals are transmitted to the following vehicle 110*d*. This ensures that vehicles do not propagate false signals, regardless of how close other vehicles are or what signals other vehicles are transmitting, and also ensures that vehicles leaving the queue 125 (e.g., by changing lanes or exiting the roadway) stop sending signals.

The method embodiments can also comprise monitoring, by the traffic queue information communication device 120*c*, receipt of first signals 211 by its communication apparatus and determining when the communication apparatus stops receiving the first signals 211 for a predetermined period of time in order to determine when the specific vehicle 110*c* reaches the starting position of the queue 125 (314). That is, once the communication apparatus 210 stops receiving signals 211 for a predetermined period of time, a determination can be made that there is no longer a vehicle in front of the specific vehicle 110*c* in the queue 125 and, thus, that the specific vehicle 110*c* is at the front of the queue 125. The vehicle at the front of the queue must be identified so that the other vehicles in the queue 125 can subsequently determine their respective positions.

The embodiments of the invention can take the form of an entirely hardware embodiment, an entirely software embodiment or an embodiment including both hardware and software elements. In a preferred embodiment, the invention is implemented in both hardware and software, where the software includes but is not limited to firmware, resident software, microcode, etc.

Furthermore, the embodiments of the invention and particularly the functions performed by the processor 220 can take the form of a computer program product accessible from a computer-usable or computer-readable medium providing program code for use by or in connection with a computer or any instruction execution system. For the purposes of this description, a computer-usable or computer readable medium can be any apparatus that can comprise, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output (I/O) devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters.

It should be understood that the corresponding structures, materials, acts, and equivalents of all means or step plus function elements in the claims below are intended to include any structure, material, or act for performing the function in combination with other claimed elements as specifically claimed. Additionally, it should be understood that the above-description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. Well-known components and processing techniques are omitted in the above-description so as to not unnecessarily obscure the embodiments of the invention.

Finally, it should also be understood that the terminology used in the above-description is for the purpose of describing particular embodiments only and is not intended to be limiting of the invention. For example, as used herein, the singular forms "a", "an" and "the" are intended to include the plural forms as well, unless the context clearly indicates otherwise. Furthermore, as used herein, the terms "comprises", "comprising," and/or "incorporating" when used in this specification, specify the presence of stated features, integers, steps, operations, elements, and/or components, but do not preclude the presence or addition of one or more other features, integers, steps, operations, elements, components, and/or groups thereof.

Therefore, disclosed above are embodiments of a vehicle-to-vehicle traffic queue information communication system, a traffic queue information communication device and a method. The system and method embodiments incorporate the use of multiple vehicles. Each vehicle is equipped with a traffic queue information communication device. Each traffic queue information communication device can be used to determine if its corresponding vehicle has entered or exited a queue in a single lane of traffic. When the vehicle is in a queue, the device can communicate with the immediately adjacent vehicles in front and behind. Specifically, it can receive data from the preceding vehicle in the queue and use the received data to determine its position in the queue as well as the estimated time it will take to travel through the queue. Revised data can then be transmitted by the device to the next vehicle in the queue for making the same determinations.

The disclosed system, device and method embodiments provide a number of advantages over prior art traffic information systems. For example, no external data collection is required (i.e., data obtained by traffic helicopters or other traffic condition monitors is not required). No central server is required (i.e., data does not need to be stored on a central server and broadcast to all vehicles). Additionally, accurate information about queue size, including each particular vehicle's position within the queue, and the average speed of the queue is provided and automatically updated at predetermined intervals. Finally, the traffic queue information being communicated between vehicles is lane-specific (as traffic flow between lanes can differ greatly depending upon the cause of the traffic congestion) and, due to the fact that the information is automatically updated, accommodates for vehicles that make lane changes or exit the roadway.

What is claimed is:

1. A vehicle-to-vehicle traffic queue information communication device, said device being installed on a specific vehicle and comprising:

a communication apparatus receiving a first signal from a directly preceding vehicle, said directly preceding vehicle being in front of and adjacent to said specific vehicle in a single lane of traffic and said first signal comprising a first set of traffic queue data comprising at least a position of said directly preceding vehicle in a queue and an average speed of said queue; and a processor determining, based on said first set of traffic queue data, a second set of traffic queue data comprising at least a position of said specific vehicle in said queue and a revised average speed of said queue, said communication apparatus further transmitting a second signal to a directly following vehicle, said second signal comprising said second set of traffic queue data and said directly following vehicle being behind and adjacent to said specific vehicle in said single lane of traffic.

2. The device according to claim 1, said processor further determining, based on said second set of traffic queue data, an estimated time until said specific vehicle reaches a starting position of said queue by multiplying said position of said specific vehicle in said queue by said revised average speed of said queue.

3. The device according to claim 2, further comprising at least one of the following:

a display visually displaying to a user of said specific vehicle at least one of said second set of traffic queue data and said estimated time until said specific vehicle reaches said starting position of said queue; and a speaker audibly providing to said user of said specific vehicle at least one of said second set of traffic queue data and said estimated time until said specific vehicle reaches said starting position of said queue.

4. The device according to claim 1, said communication apparatus comprising a line-of-sight communication apparatus.

5. The device according to claim 4, said line-of-sight communication apparatus comprising an infrared communication apparatus.

6. A vehicle-to-vehicle traffic queue information communication device, said device being installed on a specific vehicle and comprising:

a speed monitor determining when said specific vehicle enters a queue in a single lane of traffic and further determining when said specific vehicle exits said queue;

a communication apparatus receiving a first signal from a directly preceding vehicle, said directly preceding vehicle being in front of and adjacent to said specific vehicle in said queue in said single lane of traffic and said first signal comprising a first set of traffic queue data comprising at least a position of said directly preceding vehicle in said queue and an average speed of said queue;

a processor determining, based on said first set of traffic queue data, a second set of traffic queue data comprising at least a position of said specific vehicle in said queue and a revised average speed of said queue, said communication apparatus further transmitting a second signal to a directly following vehicle, said second signal comprising said second set of traffic queue data and said directly following vehicle being behind and adjacent to said specific vehicle in said single lane of traffic; and a signal monitor monitoring receipt of said first signal by said communication apparatus and determining when said communication apparatus stops receiving said first signal in order to determine when said specific vehicle reaches a starting position of said queue.

7. The device according to claim 6, said processor further determining, based on said second set of traffic queue data, an estimated time until said specific vehicle reaches said starting position of said queue by multiplying said position of said specific vehicle in said queue by said revised average speed of said queue.

8. The device according to claim 7, further comprising at least one of the following:

a display visually displaying to a user of said specific vehicle at least one of said second set of traffic queue data and said estimated time until said specific vehicle reaches said starting position of said queue; and a speaker audibly providing to said user of said specific vehicle at least one of said second set of traffic queue data and said estimated time until said specific vehicle reaches said starting position of said queue.

9. The device according to claim 6, said communication apparatus further comprising a line-of-sight communication apparatus.

10. The device according to claim 9, said line-of-sight communication apparatus comprising an infrared communication apparatus.

11. A vehicle-to-vehicle traffic queue information communication method, said method comprising:

receiving, by a traffic queue information communication device installed on a specific vehicle, a first signal from a directly preceding vehicle, said directly preceding vehicle being in front of and adjacent to said specific vehicle in a single lane of traffic and said first signal comprising a first set of traffic queue data comprising at least a position of said directly preceding vehicle in a queue and an average speed of said queue;

determining, by said traffic queue information communication device, a second set of traffic queue data, based on said first set of traffic queue data, said second set of traffic queue data comprising at least a position of said specific vehicle in said queue and a revised average speed of said queue; and transmitting, by said traffic queue information communication device, a second signal to a directly following vehicle, said second signal comprising said second set of traffic queue data and said directly following vehicle being behind and adjacent to said specific vehicle in said single lane of traffic.

12. The method according to claim 11, further comprising, determining, based on said second set of traffic queue data, an estimated time until said specific vehicle reaches a starting position of said queue.

13. The method according to claim 12, said determining of said estimated time comprising multiplying said position of said specific vehicle in said queue by said revised average speed of said queue.

14. The method according to claim 12, further comprising at least one of the following:

visually displaying to a user of said specific vehicle at least one of said second set of traffic queue data and said estimated time until said specific vehicle reaches said starting position of said queue; and audibly providing to said user of said specific vehicle at least one of said second set of traffic queue data and said estimated time until said specific vehicle reaches said starting position of said queue.

15. The method according to claim 11, said receiving and said transmitting each being performed at predetermined intervals.

16. The method according to claim 11, said receiving and said transmitting each being performed with a line-of-sight communication apparatus.

17. The method according to claim 11, further comprising, monitoring, by said traffic queue information communication device, a speed of said specific vehicle to determine when said specific vehicle enters said queue in said single lane of traffic and to further determine when said specific vehicle exits said queue.

18. The method according to claim 11, further comprising, monitoring, by said traffic queue information communication device, receipt of said first signal and determining when said communication apparatus stops receiving said first signal in order to determine when said specific vehicle reaches a starting position of said queue.

19. A non-transitory computer-readable storage medium having computer readable program code embodied therewith, said computer readable program code causing a computer to perform a method for vehicle-to-vehicle traffic queue information communication, said method comprising:

receiving, by a traffic queue information device of a specific vehicle, a first signal from a directly preceding vehicle, said directly preceding vehicle being in front of and adjacent to said specific vehicle in a single lane of traffic and said first signal comprising a first set of traffic queue data comprising at least a position of said directly preceding vehicle in a queue and an average speed of said queue;

determining, by said traffic queue information device, a second set of traffic queue data, based on said first set of traffic queue data, said second set of traffic queue data comprising at least a position of said specific vehicle in said queue and a revised average speed of said queue; and transmitting, by said traffic queue information device, a second signal to a directly following vehicle, said second signal comprising said second set of traffic queue data and said directly following vehicle being behind and adjacent to said specific vehicle in said single lane of traffic.

* * * * *

UNITED STATES PATENT AND TRADEMARK OFFICE

CERTIFICATE OF CORRECTION

PATENT NO. : 7,973,674 B2
APPLICATION NO. : 12/194581
DATED : July 5, 2011
INVENTOR(S) : David R. Bell et al.

It is certified that error appears in the above-identified patent and that said Letters Patent is hereby corrected as shown below:

On The Title Page, item (75) Inventors should read --

David R. Bell, Southampton (GB);
Christopher S. Bygrave, Eastleigh (GB);
Philip Norton, Eastleigh (GB)

Signed and Sealed this
Fourteenth Day of April, 2015

Michelle K. Lee

Michelle K. Lee
*Director of the United States Patent and Trademark Office*